US006866402B2

(12) United States Patent
Belliveau

(10) Patent No.: US 6,866,402 B2
(45) Date of Patent: Mar. 15, 2005

(54) MANUAL AND AUTOMATIC LOCKING SYSTEM FOR A MULTIPARAMETER LIGHTING FIXTURE

(76) Inventor: Richard S. Belliveau, 10643 Floral Park, Austin, TX (US) 78759

( * ) Notice: Subject to any disclaimer, the term of this patent is extended or adjusted under 35 U.S.C. 154(b) by 0 days.

(21) Appl. No.: 10/374,530

(22) Filed: Feb. 26, 2003

(65) Prior Publication Data

US 2004/0165385 A1 Aug. 26, 2004

(51) Int. Cl.[7] ..... F21V 21/26

(52) U.S. Cl. ..... 362/272; 362/85; 362/269; 315/316

(58) Field of Search ..... 362/269, 271, 362/272, 85; 340/825.22; 315/312, 316

(56) References Cited

U.S. PATENT DOCUMENTS

| | | | | |
|---|---|---|---|---|
| 4,392,187 A | | 7/1983 | Bornhorst | 362/233 |
| 4,598,345 A | * | 7/1986 | Kleeman | 362/233 |
| 5,207,747 A | * | 5/1993 | Gordin et al. | 362/233 |
| 5,590,955 A | * | 1/1997 | Bornhorst et al. | 362/324 |
| 5,882,107 A | * | 3/1999 | Bornhorst et al. | 362/281 |
| 6,113,252 A | * | 9/2000 | Arlitt et al. | 362/365 |
| 6,241,366 B1 | * | 6/2001 | Roman et al. | 362/293 |
| 6,570,348 B2 | * | 5/2003 | Belliveau | 315/315 |
| 6,600,270 B2 | * | 7/2003 | Belliveau | 315/200 A |
| 6,605,907 B2 | * | 8/2003 | Belliveau | 315/294 |

FOREIGN PATENT DOCUMENTS

EP 1001212 A2 5/2000

* cited by examiner

*Primary Examiner*—John Anthony Ward
(74) *Attorney, Agent, or Firm*—Walter J. Tencza

(57) ABSTRACT

A multiparameter lighting fixture, which includes a locking system for pan and/or tilt, either of which may include a manual input device and an actuator. The locking systems for pan and tilt can be manually locked or unlocked by a technician using their respective manual input devices and automatically locked or unlocked by their respective actuators. A yoke of the multiparameter lighting fixture can be locked in more than one rotational position in relation to the base housing. In addition, the lamp housing of the multiparameter lighting fixture can be locked in more that one rotational position in relation to the yoke. The locking systems for pan or tilt can be automatically locked by an appropriate actuator in response to an electronic control system.

51 Claims, 6 Drawing Sheets

MANUAL AND AUTOMATIC LOCKING SYSTEM FOR A MULTIPARAMETER LIGHTING FIXTURE

FIELD OF THE INVENTION

This invention relates to multiparameter lighting fixtures and the locking systems for pan and tilt.

BACKGROUND OF THE INVENTION

Multiparameter lighting fixtures are lighting fixtures, which illustratively have two or more individually remotely adjustable parameters such as focus, color, image, position, or other light characteristics. Multiparameter lighting fixtures are widely used in the lighting industry because they facilitate significant reductions in overall lighting system size and permit dynamic changes to the final lighting effect. Applications and events in which multiparameter lighting fixtures are used to great advantage include showrooms, television lighting, stage lighting, architectural lighting, live concerts, and theme parks. Illustrative multi-parameter lighting fixtures are described in the product brochure entitled "The High End Systems Product Line 2001" and are available from High End Systems, Inc. of Austin, Tex.

Multiparameter lighting fixtures are commonly constructed with a lamp housing that may pan and tilt in relation to a base housing so that light projected from the lamp housing can be remotely positioned to project on the stage surface. Commonly a plurality of multiparameter lights are controlled by an operator from a central controller. The central controller is connected to communicate with the plurality of multiparameter lights via a communication system. U.S. Pat. No. 4,392,187 titled "Computer controlled lighting system having automatically variable position, color, intensity and beam divergence" to Bomhorst and incorporated herein by reference disclosed a plurality of multiparameter lights and a central controller.

The lamp housing of the multiparameter light contains the optical components and the lamp. The lamp housing is rotatably mounted to a yoke that provides for a tilting action of the lamp housing in relation to the yoke. The lamp housing is titled in relation to the yoke by a motor actuator system that provides remote control of the tilting action. by the central controller. The yoke is rotatably connected to the base housing that provides for a panning action of the yoke in relation to the base housing. The yoke is panned in relation to the base housing by a motor actuator system that provides remote control of the panning action by the central controller.

Often times the multiparameter lighting fixtures travel by truck from one performance location (such as a concert hall) to another and require frequent loading and unloading of the multiparameter lighting fixtures by technicians. The loading and unloading process often requires frequent mounting and unmounting of the multiparameter lighting fixture by a technician onto structural support frames that are suspended above the stage set. The handling of a multiparameter lighting fixture by the technician can become cumbersome if the lamp housing can freely rotate in relation to the base while it is being carried by the technician. The prior art multiparameter lights often include a manual locking system that fixes the lamp housing in relation to the yoke and the yoke in relation to the base in a predetermined position. This keeps the lamp housing, yoke and base fixed in the predetermined position during the loading and unloading process. As a multiparameter lighting fixture is being carried by the technician, the technician insures the multiparameter lighting fixture is in the predetermined locked position, making it easier for the technician to carry and handle the fixture. After the multiparameter light is mounted to the structural support frame the technician must manually unlock the multiparameter lighting fixture so that the lamp housing can rotate freely in relation to the yoke and the yoke can rotate freely in relation to the base housing. If the technician should forget to manually unlock the multiparameter light pan and tilt locking system after mounting to the structural support frame, the multiparameter light will fail to operate properly as the lamp housing cannot be driven to rotate in relation to the yoke by the titling motor actuator and the yoke cannot be driven to rotate in relation to the base housing by the panning motor actuator.

Multiple technicians may be required to mount to the structural support frame as many as 50 to 100 multiparameter lighting fixtures during one show. The time for loading and unloading the show by the technicians at many of the show facilities may be limited as the schedule for the shows may require frequent travel between different facility locations on a day to day basis. Frequently a technician in the haste to load a show may accidentally forget to unlock the pan and tilt locking system of the multiparameter lighting fixture often requiring the technician to climb the structural support frame that may be elevated 20 to 40 feet above the stage surface. Obviously if the time is limited for loading the show the accidental mistake of forgetting to unlock the pan and tilt system of a multiparameter light can have a negative effect on the other time related aspects of loading and preparing the show.

SUMMARY OF THE INVENTION

A multiparameter lighting fixture is disclosed that may incorporate manual and remotely controllable automatic locking or unlocking systems for the pan and/or tilt of a multiparameter lighting fixture. If a technician should forget to unlock the pan and/or tilt locking or locking systems after the fixture is mounted to a structural support frame, the operator of a central controller or control system may unlock the multiparameter light pan or tilt locking systems by sending an unlock command over a communications system from the central controller to the multiparameter lighting fixture. The multiparameter lighting fixture of the invention still retains the manual locking and unlocking that can be important for the technicians so that service can be performed at any time without having to apply a source of power to the multiparameter light.

The present invention in one or more embodiments discloses a multiparameter lighting fixture comprising a base housing, a yoke, and a lamp housing. The multiparameter lighting fixture includes a locking system for pan and/or a locking system for tilt, either of which may include a manual input device and an actuator. The locking systems for pan and tilt can be manually locked by a technician using their respective manual input devices and automatically locked by their respective actuators. The locking systems for pan and tilt, similarly, can be unlocked by a technician using their respective manual input devices and automatically locked by their respective actuators.

In at least one embodiment of the present invention, the yoke can be locked in more than one rotational position in relation to the base housing. In addition, the lamp housing can be locked in more that one rotational position in relation to the yoke.

The locking systems for pan or tilt can be automatically locked by an appropriate actuator in response to an electronic control system. The electronic control system may receive a command at a communications port that causes the appropriate actuator to lock the locking system for pan or tilt: The electronic control system may receive an input command from an input keypad to automatically lock the locking system for pan or tilt by using the appropriate actuator.

The present invention includes a method for operating a multiparameter lighting fixture comprised of a base housing, a yoke, and a lamp housing comprising the steps of: manually locking a locking system for pan or tilt with a manual input device, and automatically locking the locking system for pan or tilt with an actuator.

DETAILED DESCRIPTION OF THE DRAWINGS

Figure 1:
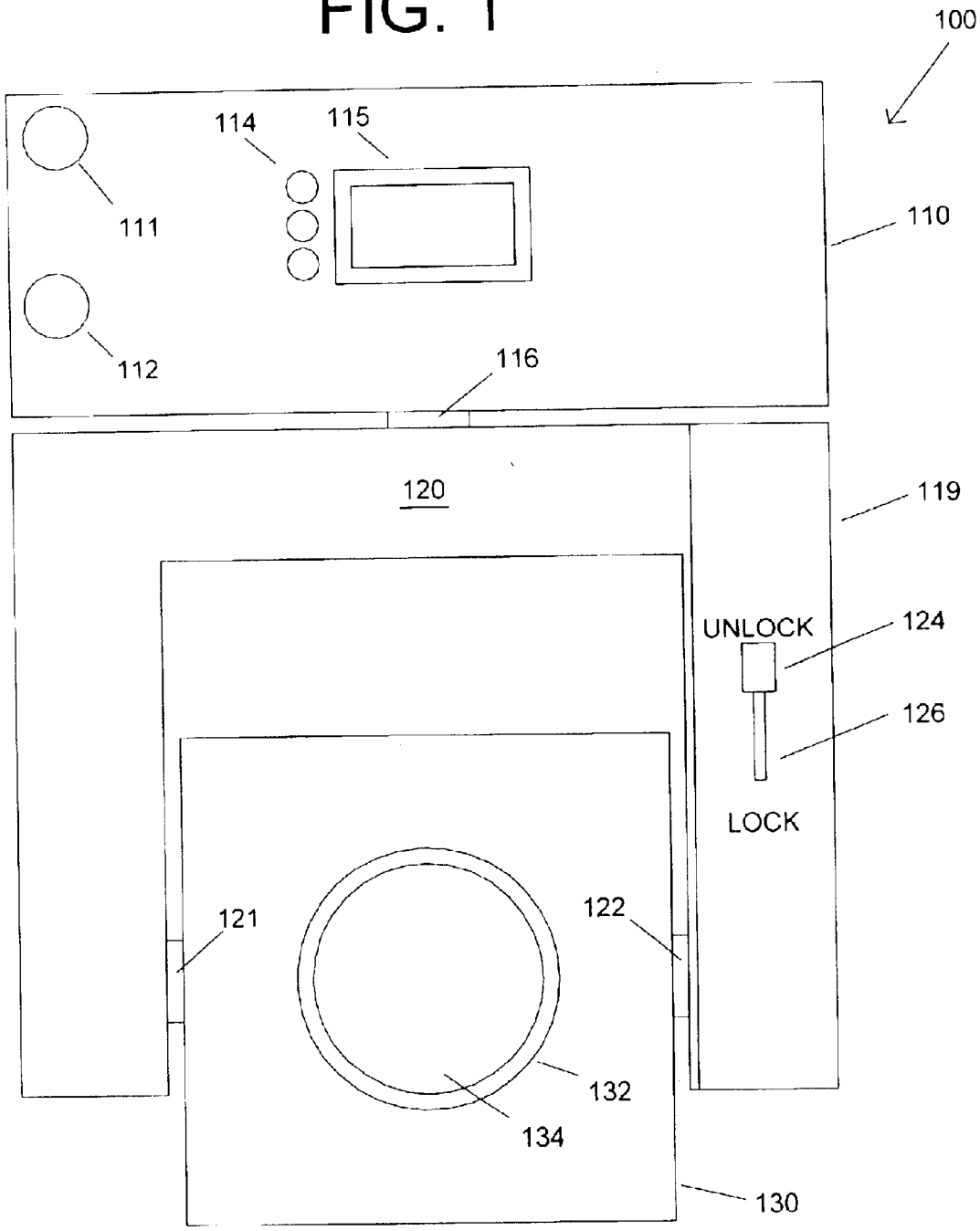
FIG. 1 shows a multiparameter lighting fixture of the invention incorporating a system for manual and automatic locking.

FIG. 1 shows a multiparameter lighting fixture 100 in accordance with an embodiment of the present invention. The multiparameter lighting fixture 100 includes a base housing 110, a bearing 116, a yoke 120, and a lamp housing 130.

The base housing 110 is rotatably connected to the yoke 120 by a bearing 116, i.e. the yoke 120 rotates or swivels with respect to the base housing 110. The yoke 120 is driven to rotate in relation to the base housing 110 by a motor actuator (not shown for simplification). The lamp housing 130 may contain various optical components including a lamp (not shown). The lamp housing 130 is rotatably connected by bearings 121 and 122 to the yoke 120. The lamp housing 130 is driven to rotate in relation to the yoke 120 by a tilt motor actuator (not shown for simplification). In some designs of multiparameter lighting fixtures the base housing 130 may be only a support bracket for mounting to the structural support and the control system 570 of FIG. 5 may be located within the yoke 120.

The lamp housing 130 has an output lens frame 132 containing a lens or aperture 134. The yoke 120 has a removable housing cover 119 that a manual input device called a lever knob 124 protrudes out of. A slot 126 for guiding the positioning of the lever knob 124 in the housing cover 119 is shown. The base housing 110 has two communications connectors 111 and 112 for connecting external communications cables 603, and 602, respectively, of FIG. 6 to the multiparameter lighting fixture 100. The communications connectors 111 and 112 may be electrically connected to provide an input and an output respectively.

A group of input keys forming a keypad 114 are shown available to the outside of the base housing 110. The keypad 114 can be used in combination with a display device 115 to act as a stand alone control system for providing input commands to the multiparameter lighting fixture 100 by an operator of the keypad 114 and the display device 115.

Figure 2:
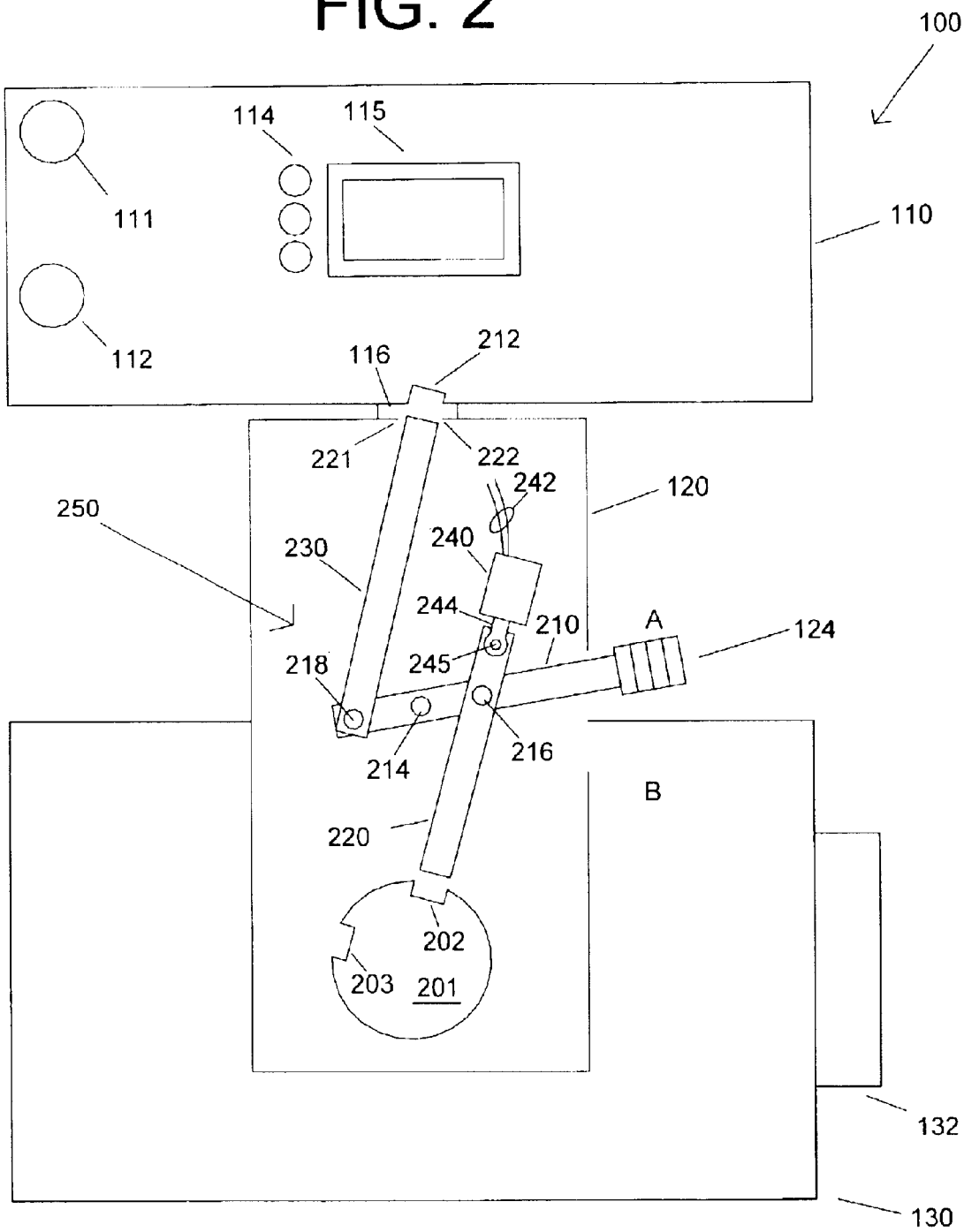
FIG. 2 shows the multiparameter lighting fixture of FIG. 1 but with a yoke of the fixture rotated ninety degrees with respect to a base housing of the fixture and a yoke housing cover removed so that the system for manual and automatic locking can be seen in the unlocked position.

FIG. 2 shows the multiparameter lighting fixture 100 with the yoke 120 rotated 90 degrees. The yoke housing cover 119 has been removed in FIG. 2, to expose the internal mechanism for manual and automatic locking of pan and tilt. The base housing 110, communications connectors 111 and 112, keypad 114, display device 115, and bearing 116 are the same components as in FIG. 1. The lamp housing 130 and output lens frame 132 is the same as in FIG. 1. A hub 201 with sockets 202 and 203 rotates with the lamp housing 130 in relation to the yoke 120. The lever knob 124, as shown in FIG. 2, is fixed to lever bar 210 in any suitable manner. The lever bar 210 is pivotally mounted to pivot point 214. The pivot point 214 is fixed to the yoke 120. A hub engaging bar 220 is pivotally mounted to a pivot point 216. The pivot point 216 is fixed to the lever bar 210. The hub engaging bar 220 is fixed to a shaft 244 of a push pull actuator 240 by a connecting pin 245. Driving wires 242 for the push pull actuator 240 are shown as 242. The driving wires 242 are run though the yoke 120, and through the bearing 116 to the base housing 110 where the driving wires 242 are electrically connected to the motor actuator interface 518 shown in FIG. 5. The motor actuator interface 518 provides driving signals to the push pull actuator 240 to linearly move the shaft 244. The view of the push pull actuator 240 and the shaft 244 are shown with the shaft 244 withdrawn into the actuator 240 or in the "pull position". A base housing engaging bar 230 is shown pivotally connected to pivot point 218 which is fixed in any suitable manner to the lever bar 210. A hole in the yoke 120 is shown by boundary points 221 and 222 that allow the base housing engaging bar 230 to pass freely though the yoke 120. The base housing engaging bar 230 passes through the yoke 120 and engages into a base housing socket 212 that is located in the base housing 110 when the base housing engaging bar 230 is placed into a locking position by the lever bar 210. In FIG. 2, the multiparameter lighting fixture 100 is shown with the locking system 250 not locked as to allow the yoke 120 to rotate in relation to the base housing 110 and the lamp housing 130 to rotate in relation to the yoke 110.

Figure 3:
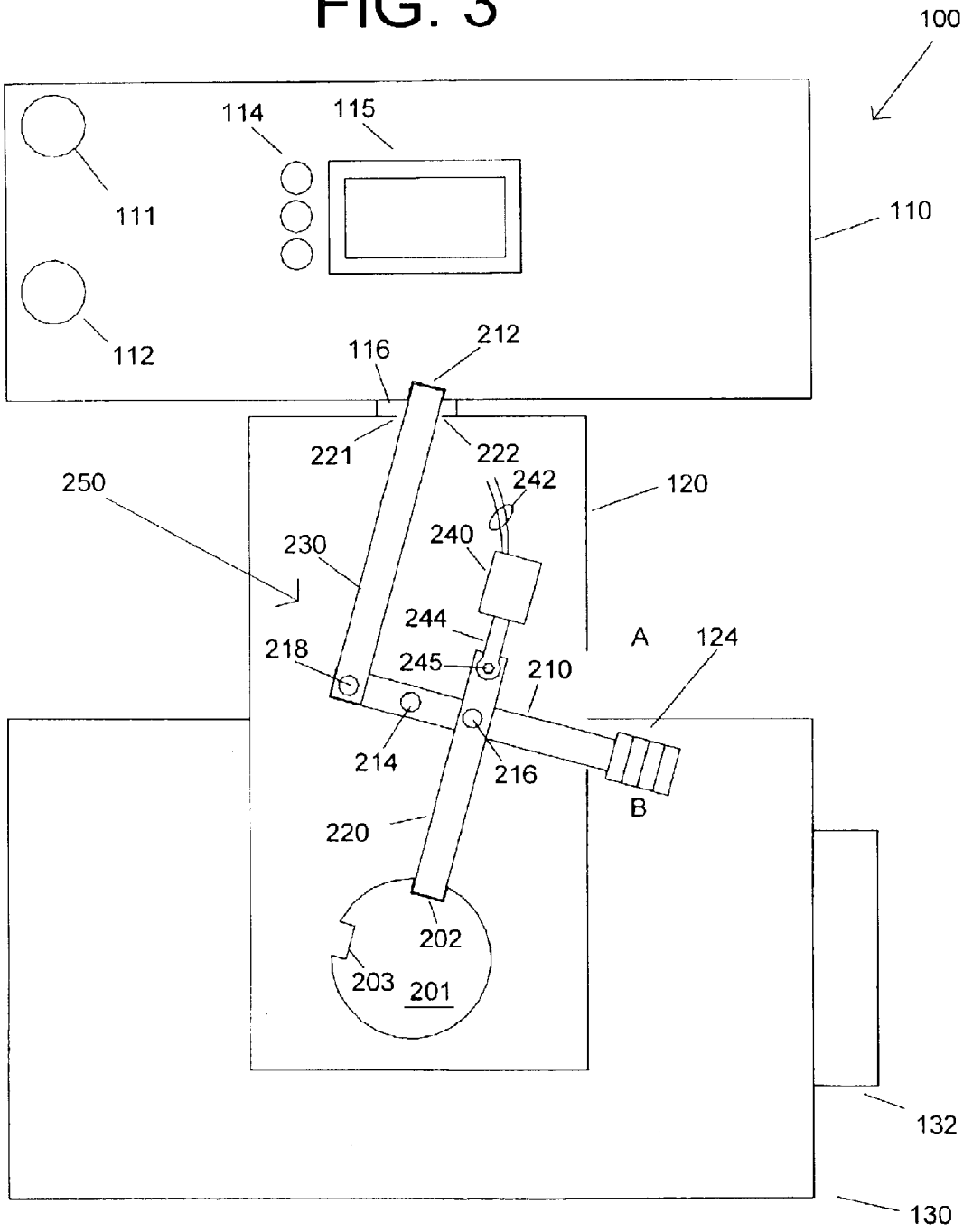
FIG. 3 shows the multiparameter lighting fixture of FIG. 2 but with the system for manual and automatic locking in the locked position.

FIG. 3 shows the same multiparameter lighting fixture 100 with the base housing 110, the yoke 120 and the lamp housing 130 in the same position in relation to each other. Referring to FIGS. 2 and 3, the lever knob 124 has been moved from position A in FIG. 2 to position B in FIG. 3 to cause the lever bar 210 to move and in turn position the hub engaging bar 220 to move into the hub socket 202. The lever knob 124 being moved to position B also causes the base housing engaging bar 230 to engage into the base housing socket 212. The shaft 244 of the push pull actuator 240 is now shown extended farther outwards into a push position in FIG. 3 as compared to the less extended position in FIG. 2.

The rotational movement of the lever bar 210 from the position A in FIG. 2 to the position B in FIG. 3 causes the locking system 250 to lock and not allow the yoke 120 to rotate in relation to the base housing 110 and to not allow the lamp housing 130 to rotate in relation to the yoke 110. The locking in FIG. 3 can be accomplished by a technician positioning the lever knob 124 from position A in FIG. 2 to position B in FIG. 3. The locking can also be accomplished sending driving signals from the motor actuator interface 518 of FIG. 5 over wires 242 causing the push pull actuator 240 to push the shaft 244 into the push position as shown in FIG. 3. The shaft 244 of the actuator 240 can be placed into the push position by driving signals over wires 242 from the motor actuator interface 518 shown in FIG. 5. When this occurs the shaft 244 pushes the lever bar 210 to place the lever bar 210 and the lever knob 124 into the locking position B causing the hub engaging bar 220 to engage into hub socket 202 locking the lamp housing 130 to the yoke 120 and the base housing engaging bar 230 to engage into the base housing socket 212 and lock the yoke 120 to the base housing 110.

Figure 4:
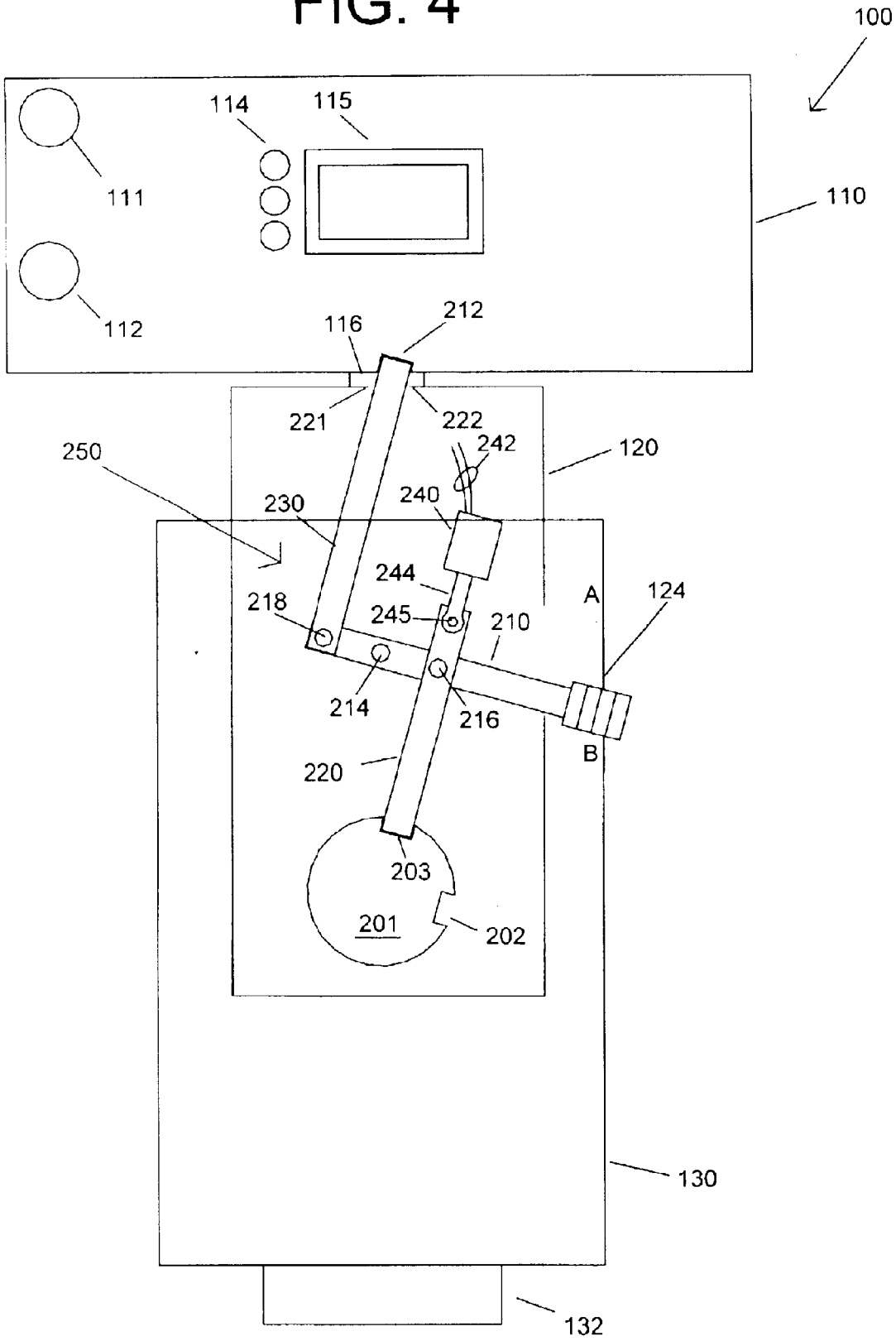
FIG. 4 shows the same multiparameter lighting fixture of FIG. 3 but with the lamp housing rotated ninety degrees in relation to the yoke and with the system for manual and automatic locking shown in the locked position.

FIG. 4 shows the multiparameter lighting fixture 100 where the lamp housing 130 has been rotated ninety degrees with respect to the yoke 120 from the position shown in FIG. 3. FIG. 4 shows that more than one rotational locking position is provided so the lamp housing 130 may be locked in at least two rotational positions in relation to the yoke 120 as determined by the hub sockets 202 and 203. More than one base housing socket like base housing socket 212 may also be provided in the base housing 110 so that the yoke 120 can be locked to the base housing 110 in several different rotational positions. More than one base housing socket 212 is not shown for simplification.

Referring to FIGS. 2 and 4, the lever knob 124 has been removed from position A in FIG. 2 to position B in FIG. 4, to cause the lever bar 210 to move and in turn position the hub engaging bar 220 into the hub socket 203. The lever knob 124 being moved to position B also causes the base housing engaging bar 230 to engage into the base housing socket 212. The shaft 244 of the push pull actuator 240 is shown extended into the push position in FIG. 4.

The movement of the lever bar 210 to position B on pivot point 214 fixed to yoke 120 causes the locking system 250 to lock and not allow the yoke 120 to rotate in relation to the base housing 110 and the lamp housing 130 not to rotate in relation to the yoke 110. The locking in FIG. 4 can be accomplished by a technician moving the lever knob 124 from position A in FIG. 2 to position B in FIG. 4. The locking can also be accomplished by sending driving signals from the motor actuator interface 518 of FIG. 5 over wires 242 causing the push pull actuator 240 to push the shaft 244 into the push position as shown in FIG. 4. The shaft 244 of the actuator 240 can be placed into the push position by driving signals over wires 242 from the motor actuator interface 518 shown in FIG. 5. This causes the shaft 244 to push against the lever bar 210 to place the lever bar 210 and the lever knob 124 into the locking position B and causes the hub engaging bar 220 to engage into the hub socket 203 locking the lamp housing 130 to the yoke 120 and causes the base housing engaging bar 230 to engage into the base housing socket 212 and lock the yoke 120 to the base housing 110.

The multiparameter lighting fixture 100 of FIG. 4 may be manually locked by the lever knob 124 by moving the lever knob 124 into the B position when the lamp housing 130 is rotated by the technician in relation to the yoke 120 as to align the hub engaging bar 220 with one of the hub sockets 202 or 203 and the yoke 120 is manually rotated to align the base housing engaging bar 230 with the base housing socket 212 or other base housing sockets (not shown for simplification). For example, a technician working with the multiparameter light fixture 100 of FIG. 1 may manually rotate the lamp housing 130 in relation to the yoke 120 and the yoke 120 in relation to the base housing 110 to lock the lamp housing 130 in relation to the yoke 120 and the yoke 120 in relation to the base housing 110 in several selectable positions as determined by the number of hub sockets and base housing sockets.

Figure 5:
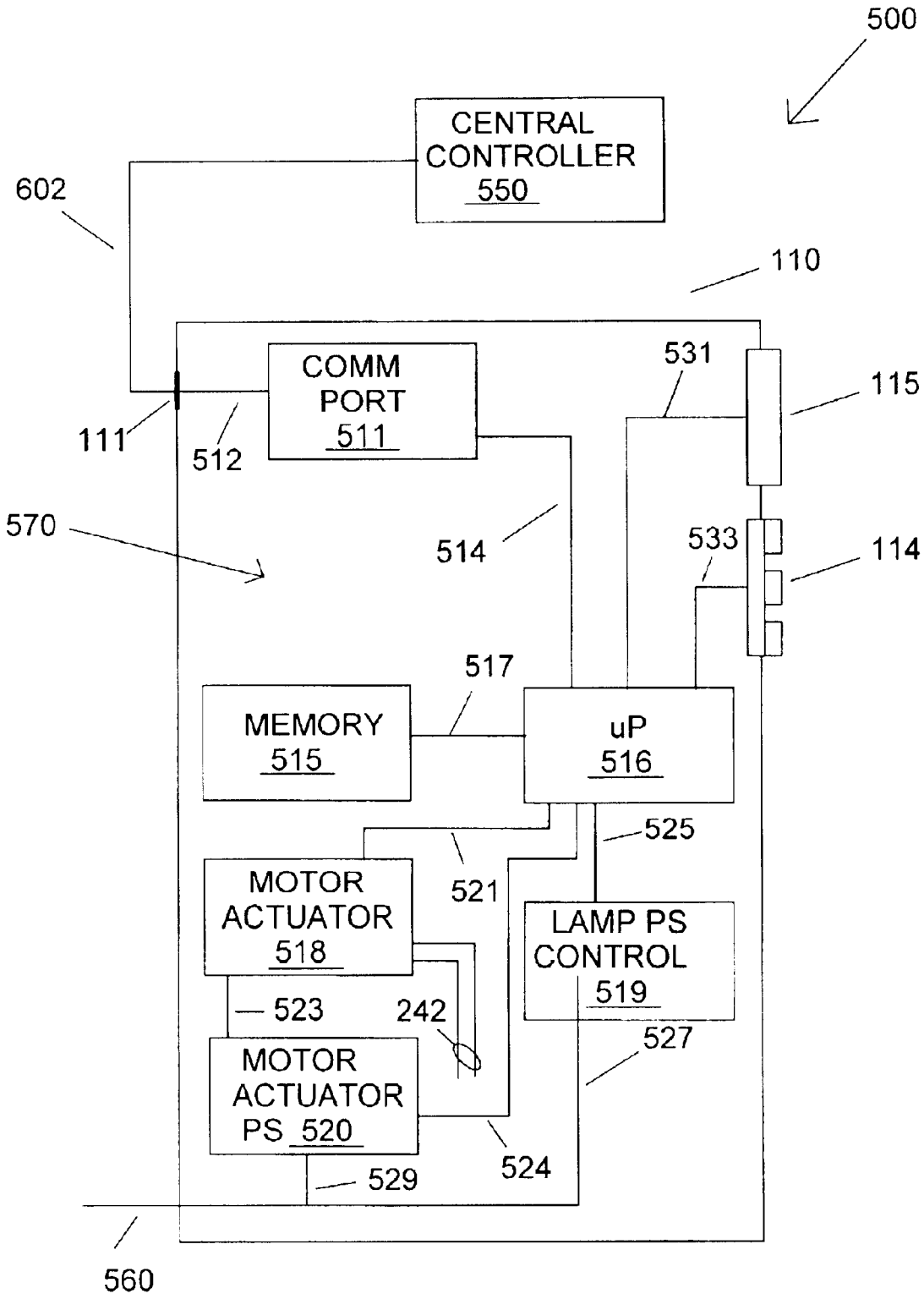
FIG. 5 shows a block layout of an electronic system in the base housing of the multiparameter lighting fixture of FIG. 1 that controls the multiparameter lighting fixture of FIG. 1.

FIG. 5 shows a block layout of a central controller 550 connected over a communications system cable 602 to the electronic control system 570 located in the base housing 110. The electronic control system 570 may be comprised of a processor 516, a memory 515, a communications port 511, a motor actuator interface 518 and a motor actuator power supply 520. The central controller 550 may send address and command signals over a communications system on cable 602 to the communications connector 111 that is connected by wire 512 to the communications port 511 located within the base housing 110. Address and command signals sent from the central controller 550 are received by the communications port 511 and then passed to the processor 516 where the address and command signals are operated upon in accordance with the operational code stored in the memory 515. The communications port 511 may be a part of the processor 516, the communications port 511 can be any device capable of receiving a communication sent over the communications system comprised of communications cable 602. An operator of the central controller 550 may use an input keyboard 635 shown in FIG. 6 to input an address of a desired multiparameter lighting fixture, such as fixture 100, to control from a plurality of multiparameter lighting fixtures, such as 100 and 101 shown in FIG. 6. If for example the operator should elect for the multiparameter lighting fixture 100 of FIG. 6 to respond to command signals the operator must first enter the address of multiparameter lighting fixture 100 into the keyboard 635 of the central controller 550 of FIG. 6. The desired address is then transmitted over the communications system via cables 602 and 603 to the multiparameter lighting fixtures 100 and 101 of FIG. 6 and received by the communications port 511 of FIG. 5. Multiparameter lighting fixture 101 can be of the same type and may have the same type of components as multiparameter lighting fixture 100 and the multiparameter lighting fixture 101 can also receive address and communication signals sent over the communication system at the communications port for 101, not shown for simplification. The communication cable 602 is connected into the base housing communications connector 111 shown in FIG. 5. The desired address as sent by the central controller 550 is carried over the communications cable 602 to the base housing communications connector 111 and then routed over wiring 512 to the communications port 511 where the address signal is sent via wiring 514 to the processor 516 shown in FIG. 5. The received address signal is then compared by the processor 516 to the operating address stored in the memory 515 to see if the received address matches the operating address stored in the memory 515. If the address received over the communications system matches the operating address stored in the memory 515 then the multiparameter lighting fixture 100 is next ready to respond to commands sent from the central controller 550 over the communications system.

Figure 6:
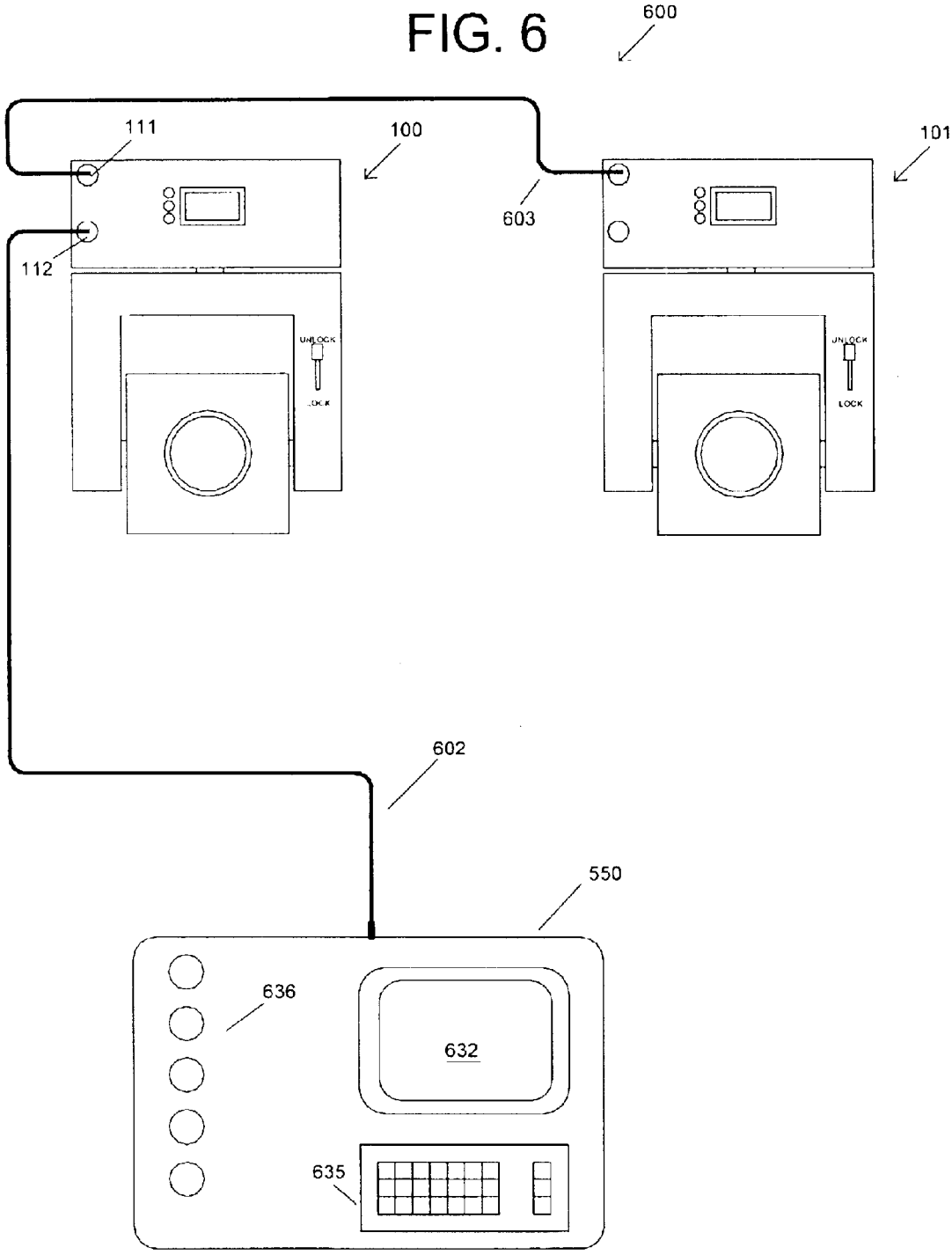
FIG. 6 shows a lighting system incorporating two multiparameter lights of one or more embodiments of the present invention and a central controller.

For FIG. 6, two multiparameter lighting fixtures 100 and 101 are shown. A lighting system may contain fifty or more multiparameter lighting fixtures that may all have separate operating addresses so as to respond to commands sent from the central controller 550 individually. After the desired address sent from the central controller 550 is matched to the operating address of the multiparameter lighting fixture 100, the multiparameter lighting fixture 100 may then respond to commands. The commands may be operated upon by the multiparameter lighting fixture 100 to vary the color, intensity, projected pattern, focus or position of the lamp housing 130 in relation to the base housing 110.

FIG. 5 shows the processor 516 which may be a plurality of processors or a set of discrete components that are able to process data. The processor 516 is connected to the memory 515 via wiring 517. The wiring 517 may be circuit board traces or other conductors. The memory 515 may be a component of the processor 516. The memory 515 contains the operational code for the multiparameter lighting fixture 100 along with the operating address. The processor 516 is connected to the display device 115, shown in FIG. 1, over wiring 531. The display device 115 may be any type of display device that is capable of displaying characters or data to a technician. The processor 516 provides the driving signals to the display device 115 so that characters and text can be read by a technician working with the multiparameter lighting fixture 100. The technician may also input control commands via the keypad 114 mounted to the base housing 110 over wiring 533 to the processor 516. The commands are then operated on by the multiparameter lighting fixture 100 in accordance with the operating software stored in the memory 515. The keypad 114 can be formed of any input devices such as buttons, switches or knobs that provide electronic signals.

The processor 516 is connected via wiring 521 to the motor actuator interface 518. The processor 516 may receive commands sent from the central controller 550 as received by the communications port 511. The commands may be processed in accordance with the operational code in the memory 515 to cause control signals to be sent to the motor actuator interface 518. The control signals sent to the motor actuator interface may in turn send the driving signals to the motor actuators (not shown) that control rotation of the lamp housing 130 in relation to the yoke 120 and rotation of the yoke in relation to the base housing 110. Also the motor actuator interface 518 may control the various motor actuators in the lamp housing 130 that produce the optical parameters as known in the art. The motor actuator 518 interface is also connected via wiring 242 to the push pull actuator 240 shown in FIGS. 2, 3 and 4. Locking and unlocking command signals received over the communication port 511 from the central controller 550 are sent to the processor 516 where they are operated upon in accordance with the operating code stored in the memory 515 and control signals are sent to the motor actuator interface 518 that drives the push pull actuator 240 to place the lever knob 124 of FIGS. 2, 3 and 4 into the A (unlocked) or B (locked) position. In this way an operator of the central controller 550 may first send the desired appropriate address to the desired multiparameter lighting fixture to be controlled from a plurality of multiparameter lighting fixtures and next the operator may send a lock or unlock command to the desired multiparameter lighting fixture, such as 100 or 101, to lock or unlock the pan and tilt locking system 250. The locking and unlocking of the pan and tilt locking system 250 by the push pull actuator 240 also simultaneously changes the position of the lever knob 124 from the A (unlocked) to the B (locked) position.

The processor 516 may also control the lamp power supply control system 519 over wiring 525 to switch on or off the lamp. The base housing 110 is connected to a source of power through wiring 560 that directs the source of power though wiring 529 to the motor actuator power supply 520. Wiring 560 also connects with wiring 527 to supply power to the lamp power supply control system 519. The processor 516 and associated electronics may receive their power from the motor actuator power supply 520 over wiring 524. Any of the wiring shown in the base housing 110 may of course be circuit board traces.

FIG. 6 shows a lighting system 600 using two multiparameter lighting fixtures 100 and 101 of one or more embodiments of the present invention 100. The lighting system 600 is comprised of the lighting fixtures 100, 101, and the central controller 550.

The central controller 550 has an input keyboard 635, a display device 632 which may be a video monitor, and several input devices such as rotary potentiometers 636. The central controller 550 has an internal communication port (not shown for simplification) that is connected to communications cable 602. Communications cable 602 is connected to one of the communications connectors, 111 or 112, of multiparameter lighting fixture 100. Communications cable 603 is connected to the other communications connector, i.e. 111 or 112, of multiparameter lighting fixture 100 and to one of the communications connectors of multiparameter lighting fixtures 101.

When the multiparameter lighting fixture 100 is not powered up and with the pan and tilt lever knob 124 in the A (unlocked) position as shown in FIG. 2, the technician can manually rotate the lamp housing 130 in relation to the yoke 120 and manually rotate the yoke 120 in relation to the base housing 110. The lamp housing 130 and the yoke 120 can be manually rotated to positions such as that shown in FIGS. 3 and 4 and then the lever knob 124 can be placed in locked position B. When the multiparameter lighting fixture 100 is connected to a source of power and connected to communicate with the central controller 550, lock and unlock commands received by the communications port 511 shown in FIG. 5 can cause the push pull actuator 240 to automatically lock or unlock the pan and tilt locking system 250 which also causes the lever knob 124 of FIG. 2 to move simultaneously to the unlocked A position or the locked B position.

There can be several locking positions for the lamp housing 130 in relation to the yoke 120 as determined by the number of hub sockets. There can also be several locking positions of the yoke 120 in relation to the base housing 110 as determined by the number of base housing sockets. It is possible for the multiparameter lighting fixture 100 to automatically lock the pan and tilt locking system 250 in any position that the hub sockets and base sockets allow. The multiparameter light 100 can contain operational code in the memory 515 that can allow multiple locking positions to be selected as a preference by an operator of the central controller 550 or by a technician using the stand alone control system formed by input keypads 114 and visual display 115. Different locking positions can be stored in the operational memory 515. When pan and tilt locking commands are sent by an operator of the central controller 550 by entering the desired locking command into the keyboard 635 or with input devices 636 the locking command is received by the desired multiparameter lighting fixture, such as 100, at the communications port 511. The command signals are sent to the processor 516 from the communications port 511 where they are acted upon by the operational code stored in the memory 515. For example if a command to lock the pan and tilt in a first position is received by the processor 516 the operational code allows the processor 516 to rotationally position the lamp housing 130 in relation to the yoke 120 a certain number of predetermined degrees so that the hub engaging bar 220 is aligned with the desired hub socket for the first position. Also the same command to lock in the first position, positions the yoke 120 to be positioned a certain number of predetermined degrees in reference to the base housing 110 so that the base engaging bar 230 is aligned with the desired base housing socket, such as socket 212. Next the push pull actuator 240 is engaged by the processor 516 to be in the push position to automatically lock the pan and tilt locking system 250 with the lever knob 124 simultaneously moved to position B (the locked position) as seen in FIG. 3. The locking of the lamp housing 130 in relation to the yoke 120 and the yoke 120 in relation to the base for the first position can be seen in FIG. 3 while a different locking or second position can be seen in FIG. 4.

The multiparameter lighting fixture 100 may be set to automatically unlock the pan and tilt locking system 250 when the multiparameter lighting fixture 100 is powered up so that when the source of power is applied to the multiparameter lighting fixture 100 at wiring 560 shown in FIG. 5, the push pull actuator 240 of FIG. 4 is driven to the pull position and the lever knob 124 is simultaneously moved to position A (the unlocked position). The preference setting to unlock the multiparameter lighting fixture 100 when the correct power is applied to wiring 560 of FIG. 5 may be done by a technician through the stand alone control system formed by the input keypad 114 and the display device 115 or the setting could occur from commands sent by the central controller 550 that are received at the communications port 511.

The technician may also use the stand alone control system to predetermine what rotational position the lamp housing 130 will be in relation to the yoke 120 and what position the yoke 120 will be in relation to the base housing 110 when a lock command is received. The lock command may be sent from the central controller 550 to the communication port 511 of the multiparameter lighting fixture 100. For example the technician may enter into the keypad 114 that the technician would like the multiparameter lighting fixture 100 to respond to a lock command received by the communications port 511 and to lock in a first or second position. The lock command could lock the pan and tilt locking system 250 for multiparameter lighting fixture 100 into a first position which may be called a default locking position or a second position. The multiparameter lighting fixture 100 may respond upon receipt of the locking command by positioning the lamp housing 130 in relation to the yoke 120 and the yoke 120 in relation to the base 110 as predetermined by the default first position setting. Thereafter the push pull actuator 240 may move to the push position to lock the pan and tilt locking system 250. In this way a locking command as commanded by the operator of the central control system 550 can be received by the communications port 511 or a plurality of multiparameter lighting fixtures and all the multiparameter lighting fixtures or selected multiparameter lighting fixtures will respond to the locking command by correctly positioning the lamp housing 130 in relation to the yoke 120 and the yoke 120 in relation to the base housing 110. Next all of the push pull actuators, similar to 240, in all of the multiparameter lighting fixtures such as 100 and 101, will automatically move to the locking position (B) of FIG. 3. All of the plurality of multiparameter lighting fixtures, such as 100 and 101 will then be in the same locking position such as the default first position as shown in FIG. 3. This allows the technician to unload the multiparameter lighting fixtures from a structural support frame without having to manually position and lock each multiparameter lighting fixture manually. If for any reason any particular multiparameter lighting fixture should need to be unlocked, to untangle a wire or cable for example, the technician need only manually move the lever knob 124 to the unlock position (A) as shown in FIG. 2.

The technician may also find it an advantage to lock and unlock the pan and tilt locking system 250 of the multiparameter lighting fixture 100 by not using the manual input device called the lever knob 124 of FIG. 2. Rather, the technician may lock and unlock the multiparameter lighting fixture 100 by inputting a command through input keypad 114. The command may send either a lock or unlock command to the processor 516 of FIG. 5 to automatically lock or unlock the pan and tilt locking system 250 using the actuator 240 of FIG. 2. Of course this will only work for the technician when the multiparameter lighting fixture, such as 100, has power applied.

In addition, an unlocking command may be sent from the central controller 550 to the plurality of multiparameter lighting fixtures, such as fixtures 100 and 101 of FIG. 6 to be received by a communications port, such as 511 shown in FIG. 5. When the plurality of multiparameter lighting fixtures receive the unlock command at their communications port, similar to 511 of FIG. 5, they should respond by unlocking their respective pan and tilt locking systems for the plurality of multiparameter lights. The unlock command is useful for when a technician accidentally forgets to manually unlock one of the plurality of multiparameter lighting fixtures such as 100 or 101 of FIG. 6 during the time the multiparameter lighting fixture was loaded on to a structural support. This prevents the technician from having to manually unlock the multiparameter lighting fixture 100 if it is difficult to approach on the structural support.

The pan and tilt locking system 250 shown in FIGS. 2, 3, and 4 is by way of example. There are other ways to design a pan and tilt locking system that is manual such as by using cams or gears. The manual locking system is comprised of a manual input device for providing a means for the technician to manually lock and unlock the pan and tilt 250. The manual input device shown in FIGS. 1, 2, 3 and 4 is a lever knob 124. The manual input device that is a part of the multiparameter lighting fixture could also be a push button, or a rotary knob that effects the locking and unlocking of pan and tilt or pan or tilt locking mechanisms. The pan and tilt locking system 250 as shown in FIGS. 2, 3, and 4 may be separated into a tilt locking system with a manual input device and an actuator and a pan locking system with manual input device and an actuator. It is preferred that only one actuator be used with one manual input device to lock both pan and tilt.

The push pull actuator 240 can be any actuator that can lock or unlock the pan and tilt locking system 250 without requiring the technician to manually provide an input to the manual input device that locks or unlocks the pan and tilt or pan or tilt locking device. The push pull actuator 240 may be a push pull electrical relay, a rotary solenoid or a motor for example.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A multiparameter fighting fixture comprising a base housing;

a yoke;

a lamp housing; and an unlocking system including a manual input device and an unlocking actuator;

wherein the manual input device is mechanically coupled to the unlocking actuator and can respond mechanically to a movement produced by the unlocking actuator;

wherein the unlocking system can be used to place the multiparameter lighting fixture in a locked state or an unlocked state;

wherein when the multiparameter lighting fixture is in the unlocked state the yoke can be rotated with respect to the base housing by a first motor actuator;

wherein when the multiparameter lighting fixture is in the locked state the yoke can not be rotated with respect to the base housing by the first motor actuator;

wherein the unlocking system is distinct from the first motor actuator; and wherein the manual input device can be used by a technician to place the multiparameter lighting fixture in an unlocked state.

2. The multiparameter lighting fixture of claim 1 wherein the unlocking actuator automatically places the multiparameter lighting fixture in the unlocked state and in response the manual input device moves to an unlocked position.

3. The multiparameter lighting fixture of claim 1 further comprising an electronic control system;

wherein the electronic control system can cause the multiparameter lighting fixture to be placed in the unlocked state.

4. The multiparameter lighting fixture of claim 3 further comprising a communications port; and wherein the electronic control system receives a command at the communications port that causes the unlocking actuator to place the multiparameter lighting fixture in the unlocked state.

5. The multiparameter lighting fixture of claim 3 further comprising an input keypad, and wherein the electronic control system receives an input command from the input keypad to automatically place the multiparameter lighting fixture in the unlocked state.

6. A multiparameter lighting fixture comprising a base housing;

a yoke;

a lamp housing; and a locking system including a manual input device and a locking actuator;

wherein the manual input device is mechanically coupled to the locking actuator and can respond mechanically to a movement produced by the locking actuator;

wherein the locking system can be used to place the multiparameter lighting fixture in a locked state or an unlocked state;

wherein when the multiparameter lighting fixture is in the unlocked state the yoke can be rotated with respect to the base housing by a first motor actuator;

wherein when the multiparameter lighting fixture is in the locked state the yoke can not be rotated with respect to the base housing by the first motor actuator;

where in the locking system is distinct from the first motor actuator;

wherein a technician can use the manual input device to manually place the multiparameter lighting fixture in the locked state;

and wherein the multiparameter lighting fixture can be automatically placed in the locked state by the locking actuator.

7. The multiparameter lighting fixture of claim 6 wherein the locking actuator automatically places the multiparameter lighting fixture in the locked state; and in response the manual input device moves to a locked position.

8. The multiparameter lighting fixture of claim 6 further comprising an electronic control system;

wherein the electronic control system causes the locking actuator to place the multiparameter lighting fixture in the locked state.

9. The multiparameter lighting fixture of claim 8 further comprising a communications port; and wherein the electronic control system receives a command at the communications port that causes the locking actuator to place the multiparameter lighting fixture in the locked state.

10. The multiparameter lighting fixture of claim 8 further comprising an input keypad; and wherein the electronic control system receives an input command from the input keypad that causes the locking actuator to automatically place the multiparameter lighting fixture in the locked state.

11. The multiparameter lighting fixture of claim 6 wherein the locking system can place the multiparameter lighting fixture in the locked state when the base housing is at a first rotational position with respect to the yoke;

and the locking system can place the multiparameter lighting fixture in the locked state when the base housing is at a second rotational position with respect to the yoke;

wherein the first and second rotational positions are different.

12. A multiparameter fighting fixture comprising a yoke;

a lamp housing;

an unlocking system including a manual input device and an unlocking actuator;

wherein the manual input device is mechanically coupled to the unlocking actuator and can respond mechanically to a movement produced by the unlocking actuator;

wherein the unlocking system can be used to place the multiparameter lighting fixture in a locked state or an unlocked state;

wherein when the multiparameter lighting fixture is in the unlocked state the lamp housing can be rotated with respect to the yoke by a first motor actuator;

wherein when the multiparameter lighting fixture is in the locked state the lamp housing can not be rotated with respect to he yoke by the first motor actuator;

wherein the unlocking system is distinct from the first motor actuator;

wherein the manual input device can be used by a technician to place the multiparameter lighting fixture in an unlocked state; and wherein the unlocking actuator can automatically place the multiparameter lighting fixture in an unlocked state.

13. The multiparameter lighting fixture of claim 12 wherein the actuator automatically places the multiparameter lighting fixture in an unlocked state and in response the manual input device moves to an unlocked position.

14. The multiparameter lighting fixture of claim 12 further comprising an electronic control system;

and wherein the electronic control system causes the unlocking system to automatically place the multiparameter lighting fixture in an unlocked state.

15. The multiparameter lighting fixture of claim 14 further comprising a communications port; and wherein the electronic control system receives a command at the communications port that causes the unlocking actuator to place the multiparameter lighting fixture in an unlocked state.

16. The multiparameter lighting fixture of claim 14 further comprising an input keypad; and wherein the electronic control system receives an input command from the input keypad to automatically cause the unlocking actuator to place the multiparameter lighting fixture in an unlocked state.

17. A multiparameter lighting fixture comprising a base housing;

a yoke;

a lamp housing;

a locking system including a manual input device and a locking actuator;

wherein the manual input device is mechanically coupled to the locking actuator and can respond mechanically to a movement produced by the locking actuator;

wherein the locking system can be used to place the multiparameter lighting fixture in a locked state or an unlocked state;

wherein when the multiparameter lighting fixture is in the unlocked state the lamp housing can be rotated with respect to the yoke by a first motor actuator;

wherein when the multiparameter lighting fixture is in the locked state the lamp housing can not be rotated with respect to the yoke by a first motor actuator;

wherein the locking system is distinct from the first motor actuator; and wherein a technician can use the manual input device to manually place the multiparameter lighting fixture in the locked state and the locking actuator can be used to automatically place the multiparameter lighting fixture in the locked state.

18. The multiparameter lighting fixture of claim 17 wherein the locking actuator automatically places the multiparameter lighting fixture in the locked state and in response the manual input device moves to a locked position.

19. The multiparameter lighting fixture of claim 17 further comprising an electronic control system;

wherein the locking actuator automatically places the multiparameter lighting fixture in the locked state in response to the electronic control system.

20. The multiparameter lighting fixture of claim 19 further comprising a communications port; and wherein the electronic control system receives a command at the communications port that causes the locking actuator to place the multiparameter lighting fixture in the locked state.

21. The multiparameter lighting fixture of claim 19 further comprising an input keypad; and wherein the electronic control system receives an input command from the input keypad to automatically place the multiparameter lighting fixture in the locked state.

22. The multiparameter lighting fixture of claim 17 wherein the locking system can place the multiparameter lighting fixture in the locked state when the lamp housing is at a first rotational position with respect to the yoke;

and the locking system can place the multiparameter lighting fixture in the locked state when the lamp housing is at a second rotational position with respect to the yoke;

wherein the first and second rotational positions are different.

23. A method for operating a multiparameter lighting fixture comprising of a base housing, a yoke, and a lamp housing comprising the steps of:

using a manual input device to manually change the multiparameter lighting fixture from a locked state to an unlocked state;

wherein the manual input device is mechanically coupled to a locking actuator and can respond mechanically to a movement produced by the locking actuator;

wherein when the multiparameter lighting fixture is in the unlocked state the yoke can be rotated with respect to the base housing by a first motor actuator;

wherein when the multiparameter lighting fixture is in the locked state the yoke can not be rotated with respect to the base housing by a first motor actuator; and further comprising automatically changing the multiparameter lighting fixture from the locked state to the unlocked state; and wherein the manual input device and the locking actuator are distinct from the first motor actuator.

24. The method of claim 23 wherein the manual input device moves to an unlocked position in response to the step of automatically changing the multiparameter lighting fixture from the locked state to the unlocked state.

25. The method of claim 23 wherein an electronic control system causes the step of automatically changing the multiparameter lighting fixture from the locked state to the unlocked state.

26. The method of claim 25 further comprising receiving a command at a communications port that causes the step of automatically changing the multiparameter lighting fixture from the locked state to the unlocked state.

27. The method of claim 25 further comprising receiving an input command from an input keypad to cause the step of automatically changing the multiparameter lighting fixture from the locked state to the unlocked state.

28. A method for operating a multiparameter lighting fixture comprised of a base housing, a yoke, and a lamp housing comprising the steps of:

using a manual input device to manually change the multiparameter lighting fixture from a locked state to an unlocked state;

wherein the manual input device is mechanically coupled to an unlocking actuator and can respond mechanically to a movement produced by the unlocking actuator;

wherein when the multiparameter lighting fixture is in the unlocked state the yoke can be rotated with respect to the base housing by a first motor actuator;

wherein when the multiparameter lighting fixture is in the locked state the yoke can not be rotated with respect to the base housing by a first motor actuator; and using the unlocking actuator to automatically change the multiparameter lighting fixture from the locked state to the unlocked state; and wherein the manual input device and the unlocking actuator are distinct from the first motor actuator.

29. The method of claim 28 wherein the manual input device moves to an unlocked position in response to the step of automatically changing the multiparameter lighting fixture from the locked state to the unlocked state.

30. The method of claim 28 wherein an electronic control system causes the step of using the unlocking actuator to automatically change the multiparameter lighting fixture from the locked state to the unlocked state.

31. The method of claim 30 further comprising receiving a command at a communications port that causes the step of automatically changing the multiparameter lighting fixture from the locked state to the unlocked state.

32. The method of claim 30 for comprising receiving an input command from an input keypad to cause the step of automatically changing the multiparameter lighting fixture from the locked state to the unlocked state.

33. The method of claim 28 wherein the locking system can place the multiparameter lighting fixture in the locked state when the yoke is at a first rotational position with respect to the base housing;

and the locking system can place the multiparameter lighting fixture in the locked state when the yoke is at a second rotational position with respect to the base housing;

wherein the first and second rotational positions are different.

34. A method for operating a multiparameter lighting fixture comprised of a base housing, a yoke, and a lamp housing comprising the steps of:

using a manual input device to manually change a multiparameter lighting fixture from a locked state to an unlocked state;

wherein the manual input device is mechanically coupled to an unlocking actuator and can respond mechanically to a movement produced by the unlocking actuator;

wherein when the multiparameter lighting fixture is in the unlocked state the lamp housing can be rotated with respect to the yoke by a first motor actuator;

wherein when the multiparameter lighting fixture is in the locked state the lamp housing can not be rotated with respect to the yoke by a first motor actuator; and using the unlocking actuator to automatically change the multiparameter lighting fixture from the locked state to the unlocked state; and wherein the manual input device and the unlocking actuator are distinct from the first motor actuator.

35. The method of claim 34 wherein the manual input device moves to an unlocked position in response to the step of the using the unlocking actuator to automatically change the multiparameter lighting fixture from the locked state to the unlocked state.

36. The method of claim 34 wherein an electronic control system causes the step of using the unlocking actuator to automatically change the multiparameter lighting fixture from the locked state to the unlocked state.

37. The method of claim 36 further comprising receiving a command at a communications port that causes the step of the using the unlocking actuator to automatically change the multiparameter lighting fixture from the locked state to the unlocked state.

38. The method of claim 36 further comprising receiving an input command from an input keypad to cause the step of automatically changing the multiparameter lighting fixture from the locked state to the unlocked state.

39. A method for operating a multiparameter lighting fixture comprised of a base housing, a yoke, and a lamp housing comprising the steps of:

using a manual input device to change a multiparameter lighting fixture from an unlocked state to a locked state;

wherein the manual input device is mechanically coupled to a locking actuator and can respond mechanically to a movement produced by the locking actuator;

wherein when the multiparameter lighting fixture is in the unlocked state the lamp housing can be rotated with respect to the yoke by a first motor actuator;

wherein when the multiparameter lighting fixture is in the locked state the lamp housing can not be rotated with respect to the yoke by a first motor actuator; and using the locking actuator to automatically change the multiparameter lighting fixture from the unlocked state to the locked state; and wherein the manual input device and the locking actuator are distinct from the first motor actuator.

40. The method of claim 39 wherein the manual input device moves to a locked position in response to the step of using the locking actuator to automatically change the multiparameter lighting from the unlocked state to the locked state.

41. The method of claim 39 wherein an electronic control system causes the step of using the locking actuator to automatically change the multiparameter lighting fixture from the unlocked state to the locked state.

42. The method of claim 41 further comprising receiving a command at a communications port that causes the step of using the locking actuator to automatically change the multiparameter lighting fixture from the unlocked state to the locked state.

43. The method of claim 41 further comprising receiving an input command from an input keypad to cause the step of using the locking actuator to automatically change the multiparameter lighting fixture from the unlocked state to the locked state.

44. The method of claim 39 wherein the locking system can place the multiparameter lighting fixture in the locked state when the lamp housing is at a first rotational position with respect to the yoke;

and the locking system can place the multiparameter lighting fixture in the locked state when the lamp housing is at a second rotational position with respect to the yoke; and wherein the first and second rotational positions are different.

45. A multiparameter lighting fixture comprising a yoke;

a lamp housing;

a locking system for pan including a manual input device;

a locking system for tilt including a manual input device and an unlocking actuator;

wherein the manual input device is mechanically coupled to the unlocking actuator and can respond mechanically to a movement produced by the unlocking actuator;

wherein the locking system for pan can place the multiparameter lighting fixture in a locked pan state or an unlocked pan state;

wherein when the multiparameter lighting fixture is in the unlocked pan state the yoke can be rotated with respect to the base housing by a first motor actuator;

wherein when the multiparameter lighting fixture is in the locked pan state the yoke can not be rotated with respect to the base housing by the first motor actuator;

wherein the locking system for tilt can place the multiparameter lighting fixture in a locked tilt state or an unlocked tilt state;

wherein when the multiparameter lighting fixture is in the unlocked tilt state the lamp housing can be rotated with respect to he yoke by a second motor actuator;

wherein when the multiparameter lighting fixture is in the locked tilt state the lamp housing can not be rotated with respect to the yoke by the second motor actuator;

wherein a technician can use the manual input device of the locking system for pan to place the multiparameter lighting fixture in a unlocked pan state;

wherein the technician can use the manual input device of the locking system for tilt to place the multiparameter lighting fixture in an unlocked tilt state;

and wherein the unlocking actuator can automatically place the multiparameter lighting fixture in an unlocked tilt state; and wherein the locking system for tilt and the locking system for pan are distinct from the first motor actuator and the second motor actuator.

46. The multiparameter lighting fixture of claim 45 wherein the manual input device of the locking system for tilt moves to an unlocked position in response the unlocking actuator of the locking system for tilt automatically placing the multiparameter lighting fixture in an unlocked tilt state.

47. The multiparameter lighting fixture of claim 45 further comprising an electronic control system;

wherein the electronic control system can cause an unlocking actuator of the locking system for pan to automatically to place the multiparameter lighting fixture in an unlocked pan state;

and wherein the electronic control system can cause the unlocking actuator of the locking system for tilt to automatically place the multiparameter lighting fixture in an unlocked tilt state.

48. The multiparameter lighting fixture of claim 47 further comprising a communications port; and wherein the electronic control system receives a command at the communications port that causes the unlocking actuator of the locking system for pan to place the multiparameter lighting fixture in an unlocked pan state; and causes the unlocking actuator of the locking system for tilt to place the multiparameter lighting fixture in an unlocked tilt state.

49. The multiparameter lighting fixture of claim 47 further comprising an input keypad; and wherein the electronic control system receives an input command from the input keypad which causes the unlocking actuator of the locking system for pan to automatically place the multiparameter lighting fixture in an unlocked pan state; and causes the unlocking actuator of the locking system for tilt to automatically place the multiparameter lighting fixture in an unlocked tilt state.

50. The multiparameter lighting fixture of claim 45 wherein the locking system for tilt can place the multiparameter lighting fixture in the locked tilt state when the lamp housing is at a first rotational position with respect to the yoke;

and the locking system for tilt can place the multiparameter lighting fixture in the locked tilt state when the lamp housing is at a second rotational position with respect to the yoke; and wherein the first and second rotational positions are different.

51. The multiparameter lighting fixture of claim 50 further comprising a keypad; and a communications port;

wherein the keypad can be used by a technician to cause a command to select whether the lamp housing will be set at the first rotational position with respect to the yoke or at the second rotational position with respect to the yoke when the multiparameter lighting fixture is in the locked tilt state.

* * * * *

UNITED STATES PATENT AND TRADEMARK OFFICE

CERTIFICATE OF CORRECTION

PATENT NO. : 6,866,402 B2
DATED : March 15, 2005
INVENTOR(S) : Belliveau, Richard S.

It is certified that error appears in the above-identified patent and that said Letters Patent is hereby corrected as shown below:

Column 12,
Line 45, “fighting” should be -- lighting --;

Column 14,
Line 26, “comprising” should be -- comprised --;

Column 15,
Lines 12 and 64, “a” should be -- the --;

Column 16,
Line 35, “a” should be -- the --;

Column 17,
Line 30, “he” should be -- the --; and
Line 50, “response the” should be -- response to the --.

Signed and Sealed this

Sixth Day of September, 2005

JON W. DUDAS
*Director of the United States Patent and Trademark Office*